US005320239A

United States Patent [19]

Favre

[11] Patent Number: 5,320,239

[45] Date of Patent: Jun. 14, 1994

[54] CASE WITH PIVOTING COVER AND ELASTIC ARTICULATION

[75] Inventor: Bernard Favre, Chevilly-Larue, France

[73] Assignee: Lir France, Chevilly-Larue, France

[21] Appl. No.: 49,701

[22] Filed: Apr. 20, 1993

[30] Foreign Application Priority Data

May 15, 1992 [FR] France ..... 92 05933

[51] Int. Cl.[5] ..... B65D 43/14

[52] U.S. Cl. ..... 220/343; 220/4.22; 220/264; 220/335

[58] Field of Search ..... 220/4.22, 4.23, 324, 220/326, 335, 342, 343, 263, 264; 215/238, 245

[56] References Cited

U.S. PATENT DOCUMENTS 2,984,380 5/1961 Kuhnl et al. ..... 220/343
4,282,983 8/1981 Swartzbaugh .
4,685,558 8/1987 Filiz et al. .
4,693,392 9/1987 Contreras, Sr. ..... 220/343
4,984,706 1/1991 Cadwell et al. ..... 220/334

FOREIGN PATENT DOCUMENTS 449335 6/1936 United Kingdom ..... 220/343

*Primary Examiner*—Allan N. Shoap
*Assistant Examiner*—Stephen Cronin
*Attorney, Agent, or Firm*—Young & Thompson

[57] ABSTRACT

A case, particularly for cosmetic products, of the type comprising a base (1), a cover (3) articulated on the edge of the base (1) and a catch (5) for the cover (3) and the base (1) on the edge opposite the articulation. The articulation of the cover (3) on the base (1) is constituted by elastically deformable pins (6), a deformation clearance being provided for each pin (6) between the base (1)and the cover (3). The base (1) or the cover (3) comprises adjacent the articulation, at least one abutment (11) parallel to the plane of the joint (12) of the base (1) and the cover (3) and/or at least one abutment (13) orthogonal to that joint plane (12).

5 Claims, 1 Drawing Sheet

CASE WITH PIVOTING COVER AND ELASTIC ARTICULATION

FIELD OF THE INVENTION

The invention relates to a case, particularly for cosmetic products, of the type comprising a base, a cover articulated on an edge of the base and catch means for latching the cover and the base on the edge opposite the articulation.

BACKGROUND OF THE INVENTION

In known cases of this type, the unlocking of the catch means leaves the cover practically closed on the base, so that the user must open it, for example by inserting a fingernail into the free space between the base and the cover. Moreover, the cover tends to return to the closed position by gravity, which militates against a rational use of the case.

To overcome this drawback, it is known to arrange a return spring, for example a helicoidal spring wound about the articulation axle and whose ends bear respectively on the base and the cover. The mounting of such a spring is complicated and difficult for cases of small dimensions such as compacts. Moreover, the return force is difficult to calibrate so as not to provoke a too abrupt and/or too complete opening.

SUMMARY OF THE INVENTION

The present invention aims to provide a new case of the preceding type in which the opening of the cover is facilitated by simple and effective means that are easy to provide.

To this end, the case according to the invention is characterized in that the articulation of the cover on the base is constituted by two elastically deformable pins, a deformation clearance being provided for each pin between the base and the cover, the base or the cover comprising adjacent said articulation at least one abutment parallel to the plane of the joint of the base and the cover and/or at least one abutment orthogonal to said joint plane.

During the closing and locking of the cover on the base, the pins deform elastically in a plane passing through the pivotal axis and substantially orthogonal to the plane of the joint for the first abutment and/or substantially parallel to this joint plane for the second abutment. There is thus assured a perfect closing of the case, determined by the abutments and, during unlocking of the cover, the pins tend to return elastically to their rectilinear position by effecting a pre-opening of the cover.

Preferably, the pins are of elastic material such as rubber. As a modification, the pins are constituted by helicoidal springs with touching turns.

According to an embodiment of the invention, a deformation clearance of each pin comprises an enlargement of the entrance to a bore within which is lodged the pin in the cover and/or the base of the case.

BRIEF DESCRIPTION OF THE DRAWINGS

The invention will be understood from a reading of the following description given with reference to the accompanying drawings in which.

DETAILED DESCRIPTION OF THE INVENTION

Figure 1:
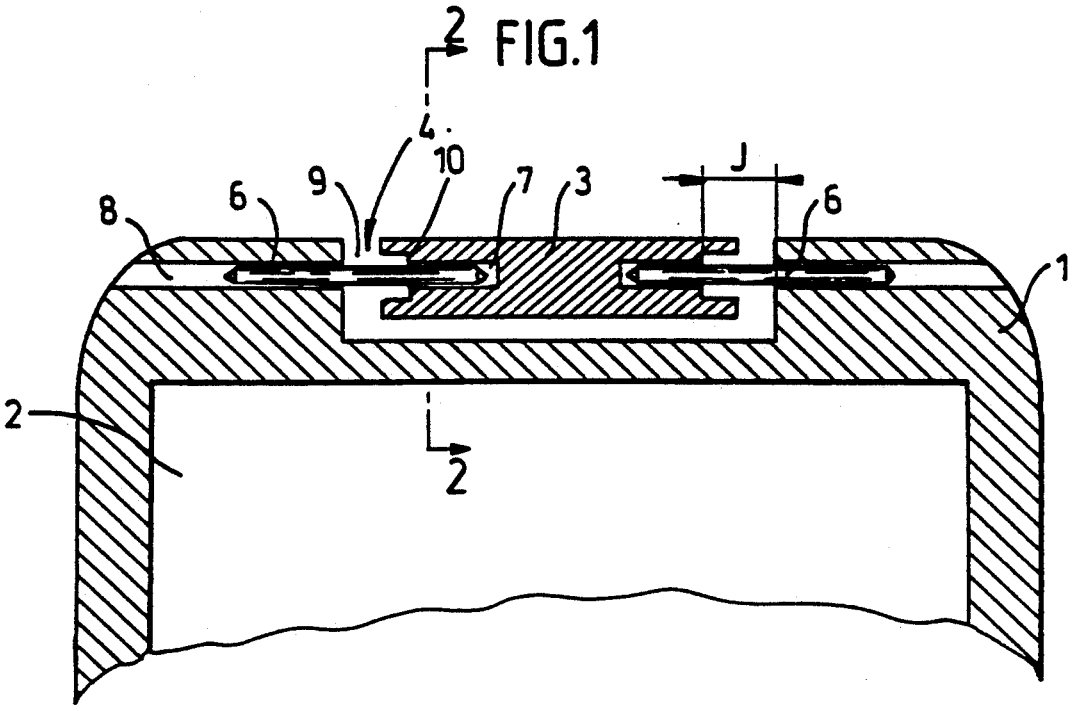
FIG. 1 is a schematic cross sectional view of a portion of a case according to an embodiment of the invention.
Figure 2:
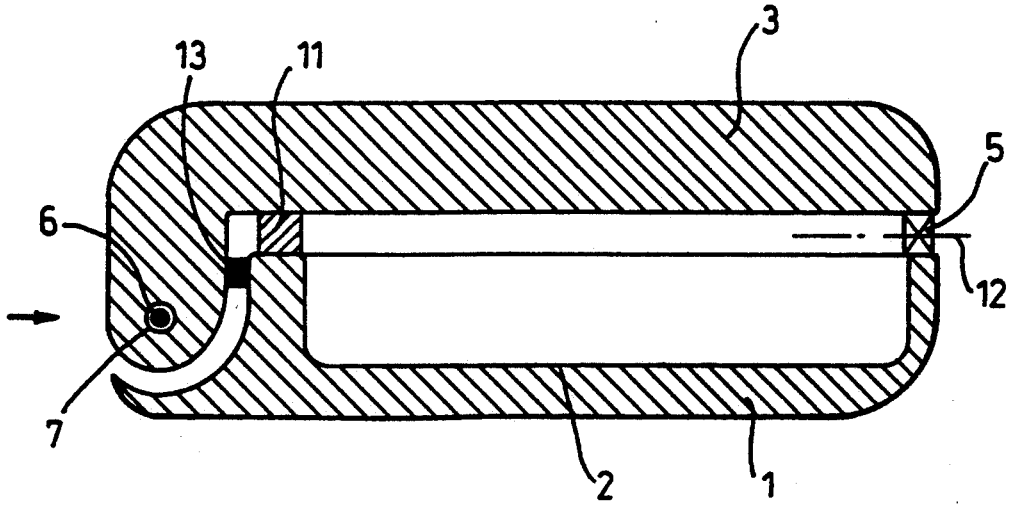
FIG. 2 is a schematic cross sectional view of a portion of a case taken along line 2—2 of FIG. 1.

The case is constituted by a base 1, provided with a recess 2 for cosmetic products, and a cover 3 mounted pivotally on the base 1 via an articulation 4. The cover 3 can be locked on the base 1 by a catch member 5 opposite the articulation 4.

According to the invention, the articulation 4 comprises two elastically deformable pins 6, for example of rubber or formed by a helicoidal spring with touching turns. Each pin 6 is disposed in a bore 7 of the cover 3 and in a bore 8 of base 1. In the illustrated example, the bore 7 is blind while the bore 8 is a through bore to permit the introduction of the pin 6 after prepositioning of the base 1 and of the cover 3.

A clearance J is provided for the elastic deformation of the pin 6. In the illustrated example, the clearance J is constituted by a clearance 9 between the base 1 and the cover 3, increased by the length of an enlargement 10 of the inlet of the bore 7 of the cover 3. Any other analogous arrangement permitting the pin 6 to deform could of course be used.

The base 1 is provided with at least one abutment 11 parallel to the plane of the joint 12 between the base 1 and the cover 3 and at least one abutment 13 orthogonal to the plane of joint 12.

During closing of the cover 3, its internal edge comes into bearing against the abutment 11 and its lateral edge against the abutment 13, before locking by the member 5. There results an elastic deformation of the pins 6 in the free spaces J. The component of deformation due to the abutment 11 is orthogonal to the plane of the sheet of FIG. 1 while the component due to the abutment 13 is parallel to this plane. After locking of the cover 3 by the member 5, the pins 6 remain deformed, and thus pre-stressed, according to the resultant of the preceding components. The respective shapes of the base 1 and the cover 3 are of course selected so that, in this closed position, the case will have the conventional continuous contour.

Upon unlocking of the member 5, the pins 6 resume their rectilinear rest position, giving rise to a pre-opening of the cover 3.

Of course, the number and the type of abutments, as well as their positioning, on the base or on the cover, or on both, can vary within the scope of the present invention.

What is claimed is:

1. A case comprising a base (1), a cover (3) articulated on an edge of said base (1) at an articulation (4) and catch means (5) for latching the cover (3) and the base (1) on an edge of the case opposite the articulation (4), the articulation (4) of the cover (3) on the base (1) comprising two elastically deformable pins (6), a deformation clearance (J) being provided for each pin (6) between the base (1) and the cover (3), one of the base (1) and the cover (3) comprising adjacent said articulation (4) at least one abutment (11, 13) engaging with the other of the base and cover.

2. A case according to claim 1, wherein the pins (6) are of rubber.

3. A case according to claim 1, wherein the pins (6) are helicoidal springs with touching turns.

4. A case according to claim 1, wherein the deformation clearance (J) of each pin (6) comprises an enlarged inlet (10) of a bore (7) for housing the pin (6) in one of the cover (3) and the base (1) of the case.

5. A case according to claim 1, wherein the pins (6) are disposed partially respectively in a through bore (8) of the base (1).

* * * * *